United States Patent [19]

Hasegawa et al.

[11] Patent Number: 4,966,073

[45] Date of Patent: Oct. 30, 1990

[54] MIMEOGRAPHIC PRINTING APPARATUS WITH A STENCIL GUIDE

[75] Inventors: Takanori Hasegawa, Hachioji; Hideo Negishi, Ibaragi, both of Japan

[73] Assignee: Riso Kagaku Corporation, Tokyo, Japan

[21] Appl. No.: 369,231

[22] Filed: Jun. 22, 1989

[30] Foreign Application Priority Data

Jun. 22, 1988 [JP] Japan ..... 63-152390

[51] Int. Cl.[5] ..... B41L 13/06

[52] U.S. Cl. ..... 101/120

[58] Field of Search ..... 101/116–120

[56] References Cited

U.S. PATENT DOCUMENTS 3,996,853 12/1976 Gates ..... 101/116

4,628,813 12/1986 Hasegawa et al. ..... 101/116

FOREIGN PATENT DOCUMENTS 0096984 6/1984 Japan ..... 101/116

0287781 12/1986 Japan ..... 101/116

*Primary Examiner*—Clifford D. Crowder

*Attorney, Agent, or Firm*—Kanesaka and Takeuchi

[57] ABSTRACT

A rotary mimeographic printing apparatus comprises a rotary drum for mounting on a peripheral surface thereof a perforated stencil, a clamp pivotally supported on the rotary drum for clamping one end of the stencil in such a manner that the stencil may be wound around the peripheral surface of the rotary drum in response to rotation of the rotary drum, structure for removing the stencil from the rotary drum after printing is finished, and a stencil guide disposed above the rotary drum and engageable with the clamp so as to move following the pivotal movement of the clamp.

16 Claims, 15 Drawing Sheets

MIMEOGRAPHIC PRINTING APPARATUS WITH A STENCIL GUIDE

BACKGROUND OF THE INVENTION

1. Field of the Invention

The present invention relates to a rotary mimeographic printing apparatus in which a perforated stencil is mounted on and removed from a rotary drum automatically.

2. Description of the Related Art

In a rotary mimeographic printing apparatus in which a perforated stencil is mounted on and around a peripheral surface of a rotary drum, a high degree of reliability is require in supplying and mounting the stencil onto the drum and also in removing and discharging the stencil from the drum.

To this end, an automatic mimeographic printing apparatus, in which perforating of a stencil, mounting of the perforated stencil, printing, and discharging of the stencil can be performed automatically, was proposed by commonly assigned Japanese Patent Laid-Open Publication No. 224573/1985 (Japanese Patent Application No. 80846/1984).

In this prior apparatus, as shown in FIG. 15 of the accompanying drawings, a clamp 103 is pivotally supported on a peripheral surface of a rotary drum 101 and clamps one end of a perforated stencil 102 supplied to the rotary drum 101. With its one end held by the clamp 103, the stencil 102 is wound around the peripheral surface of the rotary drum 101 as the rotary drum 101 is rotated. At that time the stencil 102 is attached to the peripheral surface of the rotary drum 101 by adhesion of a printing ink applied to the drum surface from the inner side of the rotary drum 101.

Upstream of the rotary drum 101, a stencil conveying means (not shown) and a cutter 104 are disposed, and downstream of the rotary drum 101, discharge rollers 105 are disposed for removing and discharging the stencil 102 from the rotary drum 101. At a position above the rotary drum 101 and between the cutter 104 and the discharge rollers 105, a guide 106 is disposed for guiding the leading end of the perforated stencil 102, which tends to be curled. In the printing apparatus of this type, since the individual stencil 102 of a suitable length to be supplied to the rotary drum 101 is provided from a roll of a stencil by cutting by the cutter 104, the stencil 102 would often assume a curled posture. If the leading end of the stencil 102 which is conveyed toward or released from the clamp 103 is curled in the direction away from the peripheral surface of the drum 101, such curled end of the stencil 102 is guided by the guide 106.

The guide 106 is in the form of a pair of plates disposed above outer ends of the clamp 103 so as not to impede pivotal movement of the clamp 103. Therefore, if the stencil 102 is curled remarkably, the central portion, which is free from any contact with the guide plates, of the stencil 102 would be deformed to a large extent, compared with the opposite marginal portions, which are guided by the guide 106 in contact with the respective guide plates. As a result, the stencil 102 would occasionally be slipped out upwardly of the guide plates, as indicated in phantom lines in FIG. 15. This phenomenon would occur not only when mounting the stencil 102 onto the drum 101 but also when discharging the stencil 102 from the drum 101.

SUMMARY OF THE INVENTION

It is therefore an object of the present invention to provide a mimeographic printing apparatus in which a stencil can be conveyed to a clamp on a rotary drum so as to be held by the clamp reliably when the stencil is to be mounted on and around a peripheral surface of the rotary drum, and in which the stencil can be conveyed from the rotary drum to a stencil discharging means after the stencil is released from the clamp when the stencil is to be discharged from the rotary drum.

According to the present invention, a mimeographic printing apparatus comprises a rotary drum for mounting on a peripheral surface thereof a perforated stencil, a clamp pivotally supported on the rotary drum for clamping one end of the stencil in such a manner that the stencil may be wound around the peripheral surface of the rotary drum in response to rotation of the rotary drum, means for removing the stencil from the rotary drum after printing is finished, and a stencil guide disposed above the rotary drum and engageable with the clamp so as to move following the pivotal movement of the clamp.

With this arrangement, since the stencil guide is disposed above the clamp, the stencil guide is engageable with the clamp so as to move following the pivotal movement of the clamp when the stencil is mounted on or removed from the rotary drum. Therefore, the stencil guide does not impede the pivotal movement of the clamp. When mounting the stencil on the drum, there is no danger that the leading end of the stencil could project beyond the distal end of the clamp. Therefore the stencil can be guided by the stencil guide reliably so as to be held by the clamp. When discharging the stencil from the drum, the stencil can be guided to removing means reliably by the stencil guide dispose above the clamp.

BRIEF DESCRIPTION OF THE DRAWINGS

FIG. 7(*b*) is a cross-sectional view showing a modified form of the stencil guide of FIG. 5 and a modified form of the clamp of FIG. 5;

DETAILED DESCRIPTION OF THE PREFERRED EMBODIMENTS

FIGS. 1 through 4 illustrate a rotary mimeographic printing apparatus (hereinafter called "apparatus") 1 having a perforated-stencil making unit 2.

Figure 1:
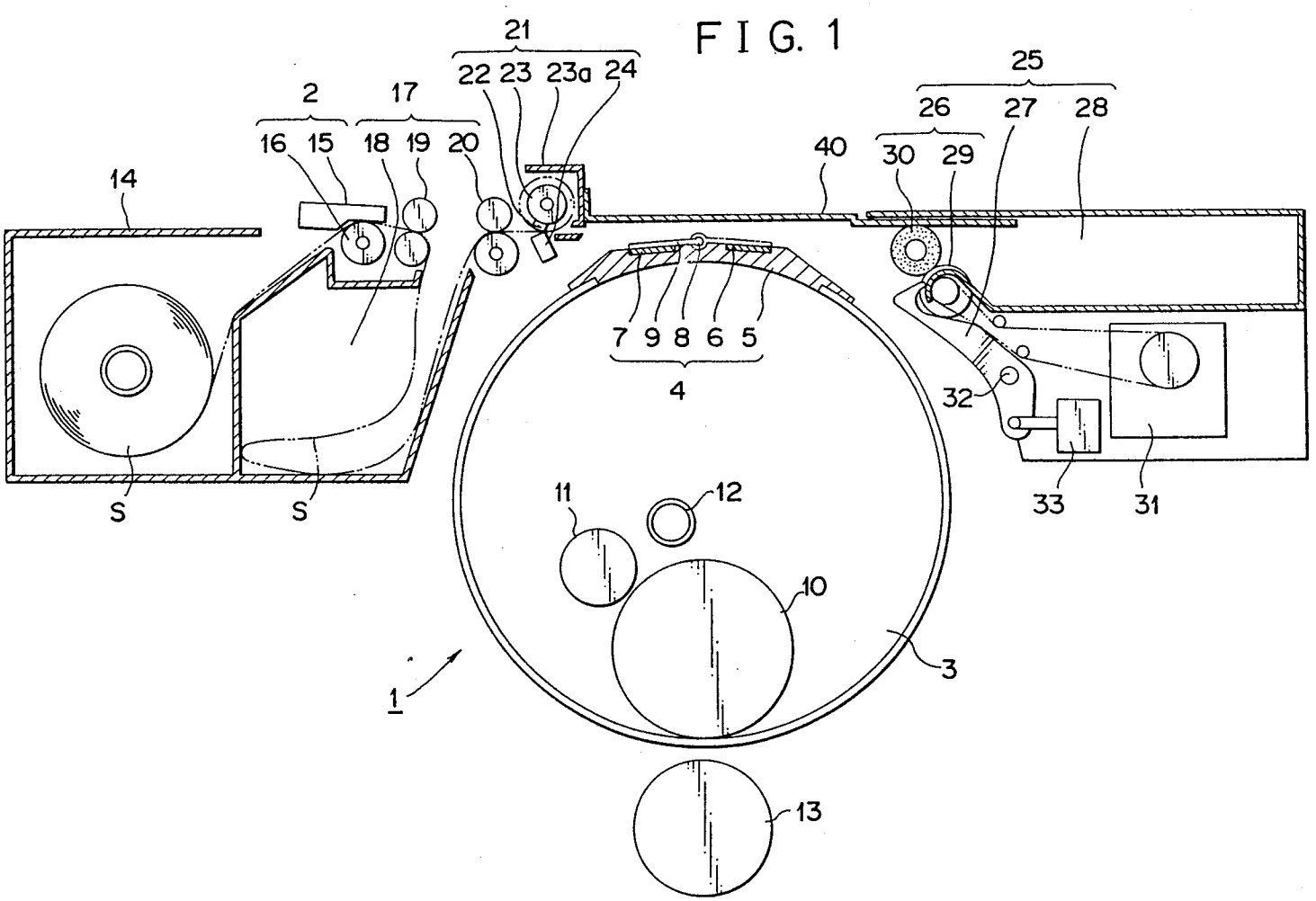
FIG. 1 is a cross-sectional view of a mimeographic printing apparatus according to a first embodiment of the present invention.
Figure 2:
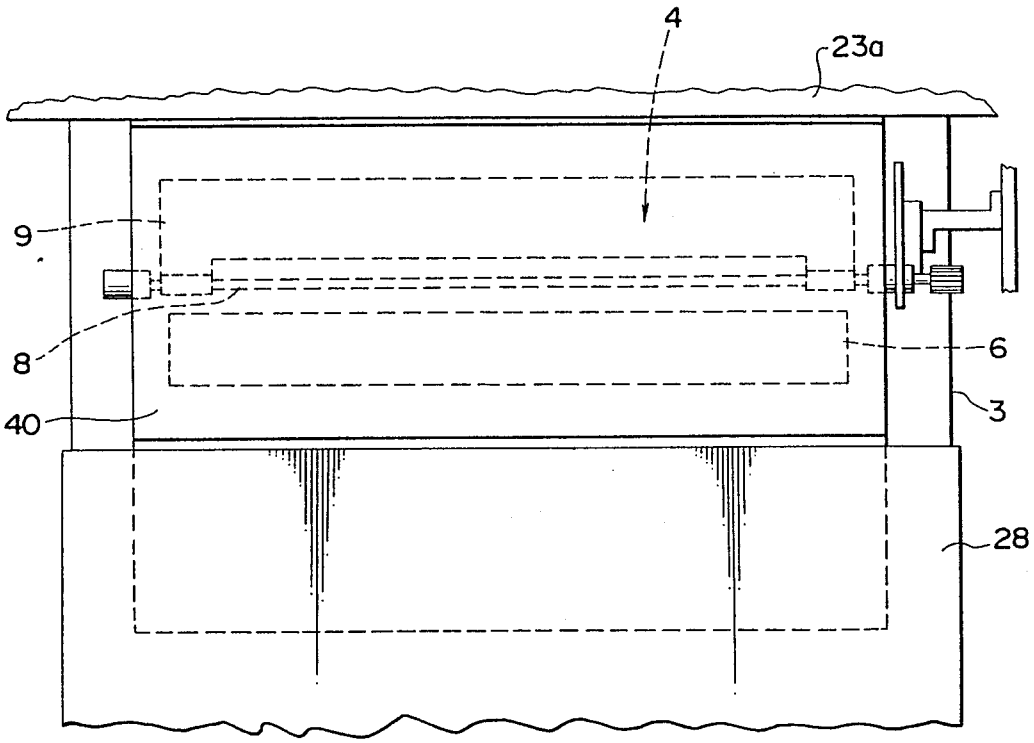
FIG. 2 is a fragmentary plan view of the apparatus of FIG. 1, showing a stencil guide and a clamp.

As shown in FIGS. 1 and 2, the apparatus 1 generally comprises a rotary drum 3 for mounting on and around a peripheral surface thereof a perforated stencil S, and a perforated-stencil clamping unit 4 supported on a part of the peripheral surface of the rotary drum 3 for selectively holding one end of the perforated stencil S. The rotary drum 3 is in the form of a porous cylindrical body which is operatively connected to a non-illustrated motor for clockwise rotation about its longitudinal center line. With its one end held by the clamping unit 4, the perforated stencil S is wound around the peripheral surface of the rotary drum 3 as the rotary drum 3 is rotated. At that time the perforated stencil S is attached onto the peripheral surface of the drum 3 by adhesion of a printing ink Which are supplied onto the peripheral surface of the drum 3 from the interior side thereof via a multiplicity of small openings of the rotary drum.

The clamping unit 4 includes a pair of magnet plates 6, 7 fixedly secured to a stencil mounting seat 5 mounted on the peripheral surface of the rotary drum 3, and a clamp 9 in the form of a metal thin plate pivotally connected to the stencil mounting seat 5 by a pivot 8. The clamp 9 is magnetically attracted to the magnet plate 7 to clamp one end of the perforated stencil S. The clamp 9 is pivotally movable between a first clamp position in which the clamp 9 is attracted to the magnet plate 7 and a second clamp position (indicated in phantom lines) in which the clamp 9 is attracted to the other magnet plate 6. The holding and releasing of the perforated stencil S are automatically performed as the clamp 9 is driven by a non-illustrated drive means for pivotal movement.

In the rotary drum 3, there is mounted an ink supply unit which is composed of a squeeze roller 10, a doctor rod 11, and an ink supply pipe 12. The ink supply unit is operable, in response to rotation of the rotary drum 3, to supply a printing ink to an inner peripheral surface of the drum 3.

Disposed below the rotary drum 3 is a press roller 13 facing against to the squeeze roller 10 for pressing a non-illustrated print paper against the outer peripheral surface of the drum 3. Thus the press roller 13 cooperates with the rotary drum 3 to perform the mimeographic printing.

A stencil supply unit 14 is disposed upstream of the rotary drum 3. The stencil S in the form of a continuous paper wound in a roll is accommodated in the supply unit 14.

A stencil perforating unit 2 is disposed between the stencil supply unit 14 and the rotary drum 3. The perforating unit 2 is a thermo-sensitive type and hence includes a thermal head 15 and a platen roller 16, wherein the thermal head 15 and the platen roller 16 cooperate to form a pattern of perforations thermo-sensitively in a fresh stencil S supplied from the stencil supply unit 14 to the perforating unit 2, thus providing a perforated stencil S as an original.

A perforated-stencil stocking unit 17 is disposed between the perforating unit 2 and the rotary drum 3. The stocking unit 17 includes a stock box 18 for accommodating in meanders the perforated stencil S for a length which is several times longer than one usage of the perforated stencil, a pair of drawing rollers 19 for drawing the continuous perforated stencil S from the perforating unit 2 to the stock box 18, and a pair of delivery rollers 20 for conveying the perforated stencil S from the stock box 18 to a stencil cutting unit 21.

The stencil cutting unit 21 is disposed between the and the delivery rollers 20 and the rotary drum 3. The cutting unit 21 is composed of a rotary cylindrical blade 23 having a helical cutting edge 22, and a plain blade 24 engageable with the rotary blade 23. The two blades 23, 24 cooperate to cut the continuous perforated stencil S.

A perforated-stencil discharging unit 25 is disposed downstream of the rotary drum 3. The discharging unit 25 includes a pair of discharge rollers 26, a perforated-stencil scraper claw 27, and a used-stencil disposal box 28.

The discharge rollers 26 are composed of a metal roller 29 supported by a lower rotary shaft disposed at an inlet of the disposal box 28, and a rubber roller 30 supported by an upper rotary shaft and engageable with the metal roller 29. The metal roller 29 is operatively connected to a motor 31 for clockwise rotation. The discharge rollers 26 are located at a position such that the discharge rollers 26 are very close to the clamping unit 4 when the rotary drum 3 is in its stencil mounting and removing position.

The scraper claw 27 is pivotally supported on the frame by a pivot 32, and one end (remote from a distal scraping end) of the claw 27 is connected to a plunger of a solenoid unit 33. As driven by the solenoid unit 33, the scraper claw 27 is pivotally moved counterclockwise about the pivot 32 from a retracted position of FIGS. 1, 2 and 4 to a scraping position (not shown) in which the distal scraping end of the claw 27 is close to the peripheral surface of the rotary drum.

Most importantly, a perforated-stencil guide (hereinafter called "guide") 40 is disposed above the rotary drum 3 for engagement with the clamp 9 as the clamp 9 is pivotally moved when the rotary drum 3 is in the stencil mounting and removing position. In engagement with the clamp 9, the guide 40 is moved following the pivotal movement of the clamp 9. In the specification, the wording "to be moved following the pivotal movement of the clamp" means "to be moved or deformed so as not to impede the pivotal movement of the clamp".

In the first embodiment, the guide 40 is a flexible member which is deformable when the clamp 40 is forced against the flexible member. As shown in FIG. 2, the flexible guide 40 is in the form of a single plate having a width larger than the width of the clamp 9 and fixedly secured, at one edge adjacent to the cutting unit 21, to a case 23*a* of the rotary blade 23. The other edge of the guide plate projects into the disposal box 28 and is freely movable therein.

Figure 3:
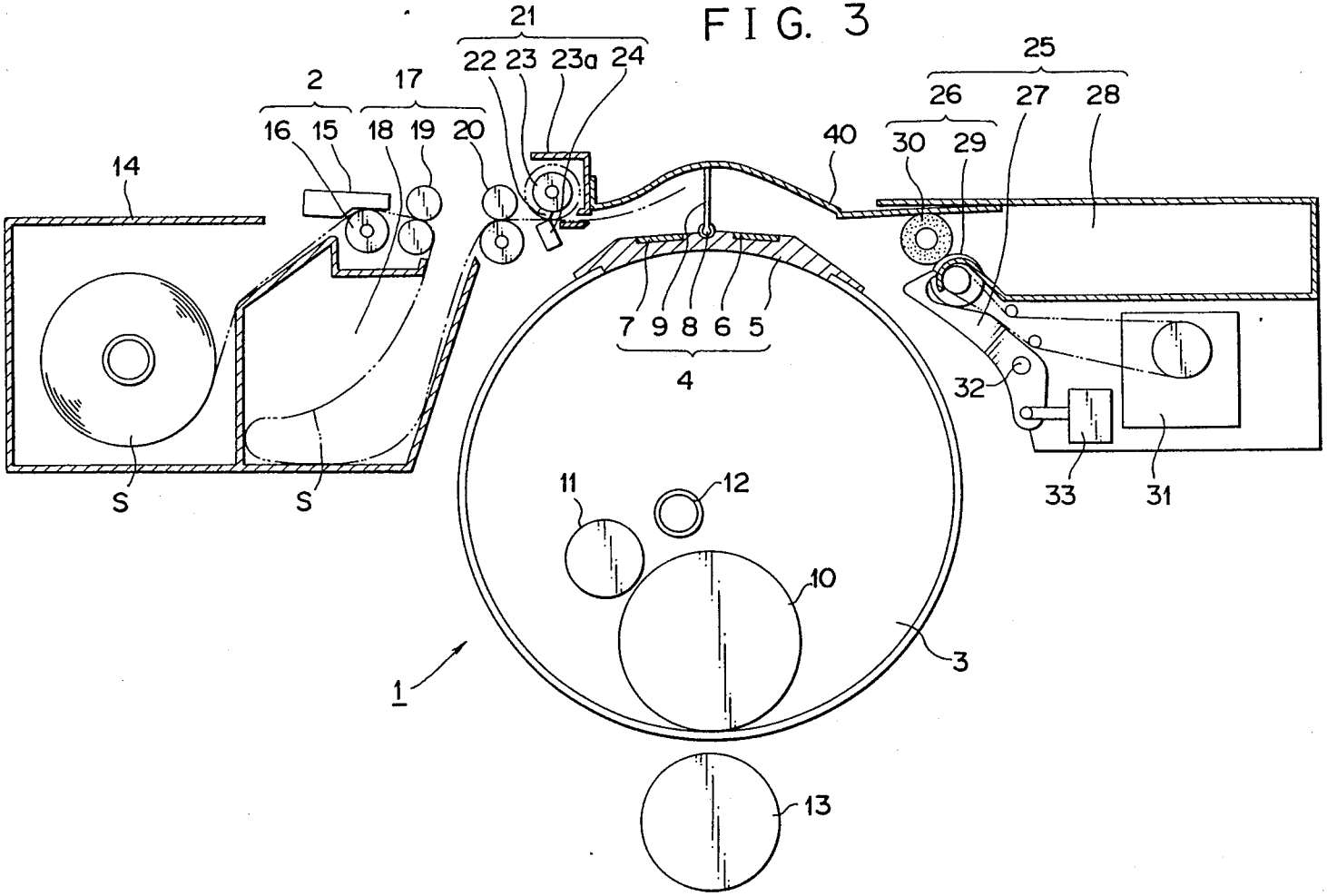
FIGS. 3 and 4 are views similar to FIG. 1, illustrating the manner in which the apparatus of FIG. 1 operates.
Figure 4:
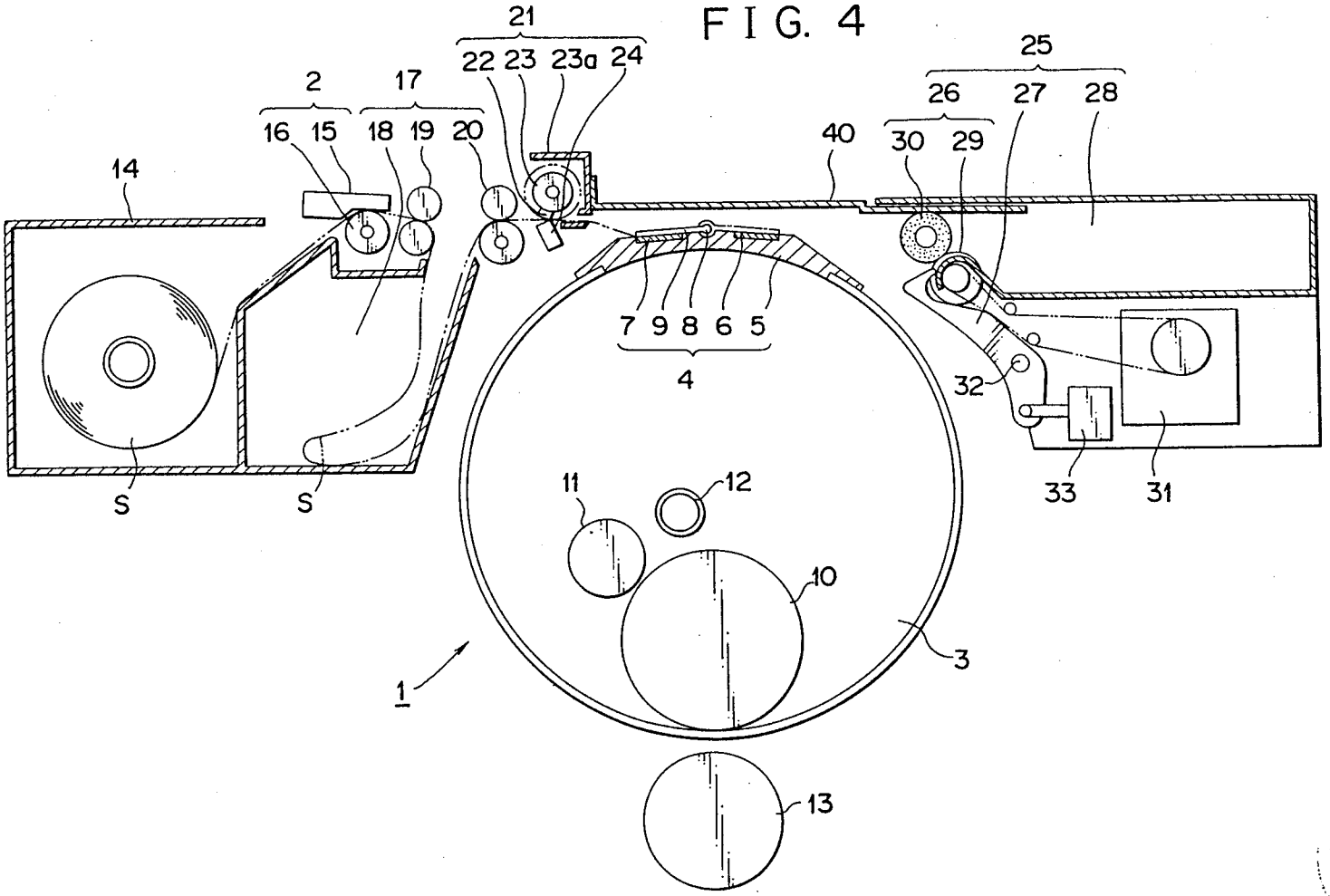

The mode of operation of the apparatus of the first embodiment will now be described with reference to FIGS. 3 and 4.

At the very start of the perforating and printing operations, there is no perforated stencil S in the stocking box 18, and the stencil S extends from the drawing rollers 19 to the delivery rollers 20 directly and terminates in a leading end reaching the cutting unit 21. In this condition, an image information signal is given to the thermal head 15 of the perforating unit 2 to initiate the perforating operation. As the stencil S is progressively perforated, the perforated stencil S is introduced little by little into the stocking box 18 as driven by the drawing rollers 19.

Upon completion of perforation of an individual original stencil required for printing, the delivery rollers 20 are driven for rotation to thereby convey the leading end of the perforated stencil S to the clamp 9, whereupon the leading end of the perforated stencil S is held against the rotary drum 3 by the clamp 9.

At that time, the clamp 9 is pivotally moved away from the magnet plate 6 toward the magnet plate 7 to hold the perforated stencil S. And the free end of the clamp 9 is brought in contact with the lower surface of the guide 40 to flex the guide 40 upwardly. More specifically, the guide 40 can be deformed following the pivotal movement of the clamp 9 and hence does not impede the pivotal movement of the clamp 9. Further, since the guide 40 is disposed above the clamp 9, the leading end of the perforated stencil S can be guided reliably through its entire width even if the perforated stencil S is curled remarkably. As a consequence, the leading end of the perforated stencil S is introduced to the clamp 9 to only a necessary extent, whereupon such adequate length of the leading portion of the perforated stencil S is clamped between the clamp 9 and the magnet plate 7, as shown in FIG. 4.

Upon completion of clamping of the perforated stencil the rotary drum 3 is driven to rotate in a clockwise direction. In response to this clockwise rotation, the perforated stencil S is wound on the rotary drum 3. When the perforated stencil S with length necessary or printing is wound around the peripheral surface of the rotary drum 3, the rotation of the delivery rollers 20 is topped and, at the same time, the cutting unit 21 is driven o cut the perforated stencil S. As a result, the necessary length of the perforated stencil S has been mounted on the rotary drum 3. Then continued rotation of the rotary drum 3 initiates for the mimeographic printing.

Throughout the stencil-mounting operation and the printing operation, the perforation of the stencil S is continued by the perforating apparatus 2, and the thus perforated stencil S is conveyed into the stock box 18 and is stocked therein in order.

After the printing operation is completed, the perforated stencil S is to be removed from the peripheral surface of the rotary drum 3 for discharge. Firstly, the clamp 9 of the clamping unit 4 is pivotally moved by deforming the guide 40 and is attracted to the other magnet plate 6 to release the one end of the perforated stencil S. Then, he scraper claw 27 is pivotally moved from the retracted position of FIG. 4 to the scraping position in which the distal scraping end is close to the peripheral surface of he rotary drum 3. With the scraper claw 27 in the scraping position, as the rotary drum 3 is rotated clockwise in FIG. 4, the perforated stencil S is peeled off from its one end the scraper claw 27. Then the leading end of the peeled perforated stencil S, as guided by the distal scraping end the scraper claw 27, enters between the metal roller 29 d the rubber roller 30. In response to the clockwise (as viewed in FIG. 4) rotation of the metal roller 29 and in response to the counterclockwise (as viewed in FIG. 4) station of the rubber roller 30, the perforated stencil S sandwiched between the two rollers 29, 30 and is thereby discharged into the disposal box 28.

As the perforated stencil S is released, the released d of the perforated stencil S tends to be curled away from e peripheral surface of the rotary drum 3. The guide 40 disposed above the clamp 9 guides such released end of the perforated stencil S reliably throughout its entire width. therefore, even if the perforated stencil S is curled to a remarkable extent, the deformation of the perforated stencil S n be restricted so as not to enlarge the curl. The guide also serves to guide the released end of the perforated stencil S to the rollers 26. Since the lease end of the stencil S is moved to the rollers 26 reliably and the stencil S is then moved into the disposal box 28 reliably, it is possible to avoid any correct discharge of the used stencil S.

Figure 5:
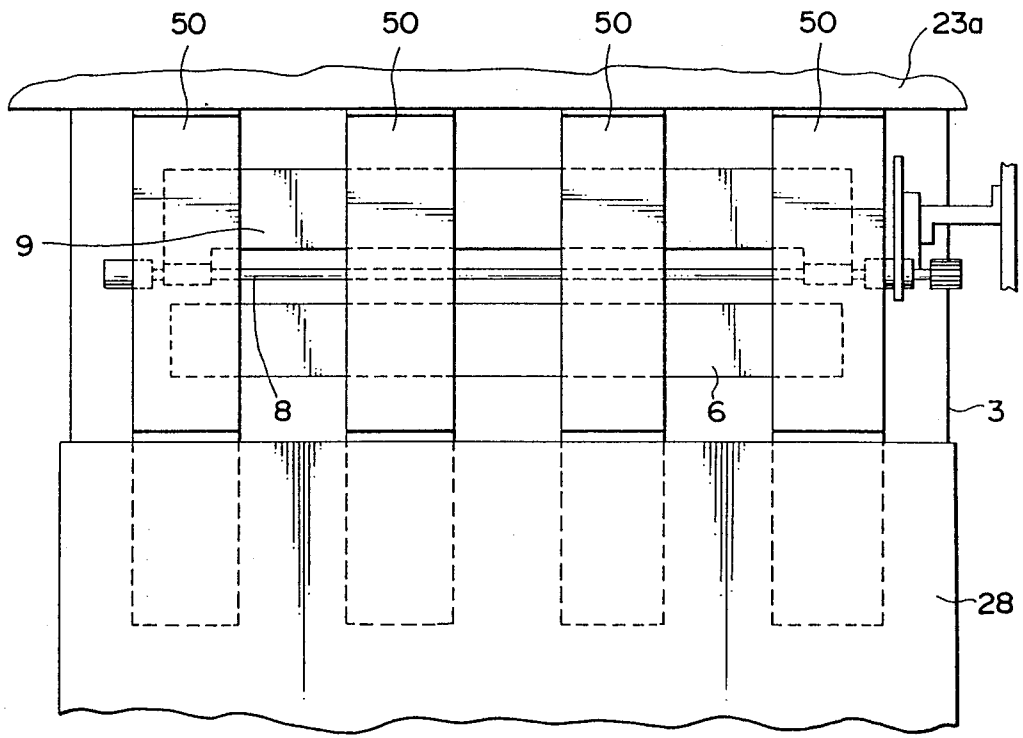
FIGS. 5 and 6 are views similar to FIG. 2, showing modified stencil guides.
Figure 6:
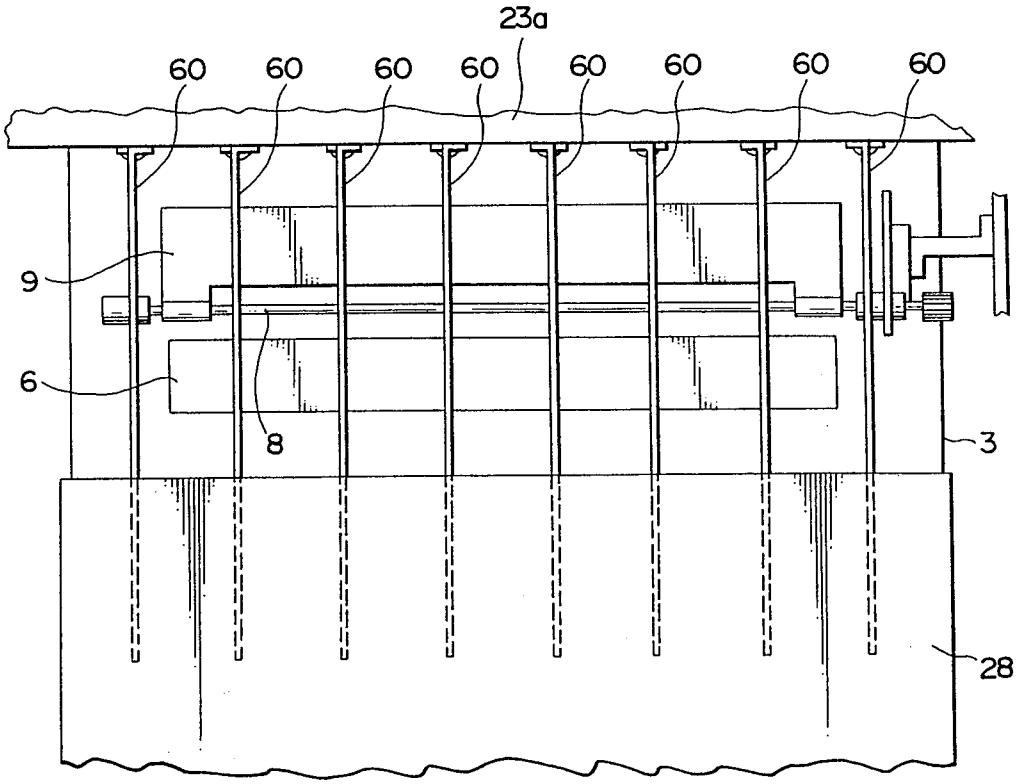

In the embodiment of FIGS 1 through 4, the guide 40 composed of a single flexible plate. Alternatively, as own in FIG. 5, a modified guide 50 may be composed of a plurality of flexible strips engageable with the clamp 9 pivotally moved. In this modified form, if the stencil S is curled significantly, a part of one end of the stencil S is not engageable with any guide strip, but at least a part of one end of the stencil S is engageable with the individual guide strips. The result of this modified guide 50 is substantially the same as that of the guide 40 of FIGS. 1 through 4. In another alternative form, as shown in FIG. 6, the guide 50 may be substituted by another modified guide 60 which is composed of a plurality of flexible rods engageable with the clamp 9 being pivotally moved.

In the first embodiment of FIGS. 1 through 6, each of the flexible guides 40, 50, 60 is stationary at one end and free at the other end. However, each of these guides 40, 50, 60 may be fixed at both ends. In the case of the cantilevered guides, any one of the opposite ends may be fixed.

Figure 7A:
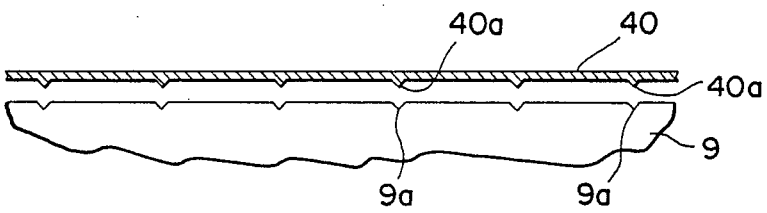
FIG. 7(*a*) is a cross-sectional view showing a modified form of the stencil guide of FIG. 2 and a modified form of the clamp of FIG. 2.
Figure 7B:
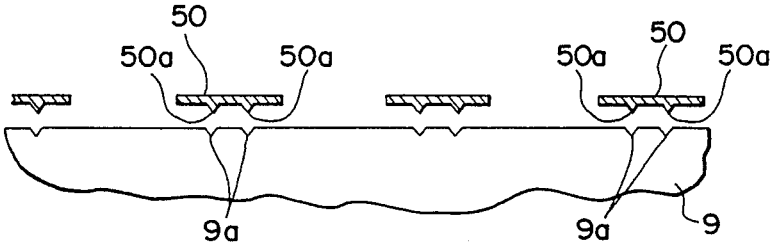

As mentioned above, if the stencil S is curled to a remarkable extent, the leading end of the stencil S comes into contact with the lower surface of the guide 40, 50 or 60. In order to minimize the amount of frictional resistance, each of the guides of FIGS. 2 and 5 may have on its under surface a plurality of ridges 40*a*, 50*a*, respectively, at suitable distances, as shown in FIGS. 7(*a*) and 7(*b*), each of the ridges having a V-shaped cross section. With this arrangement, it is possible to guide the perforated stencil S more smoothly. Further, as shown in FIGS. 7(*a*) and 7(*b*), the clamp 9 may have in its distal end a plurality of grooves 9*a* corresponding to the ridges 40*a*, 50*a*. When mounting the stencil S on the rotary drum 3, the grooves 9*a* also serve to assist in holding the leading end of the stencil S between the clamp 9 and the magnet plate 7 with improved smoothness.

Figure 8:
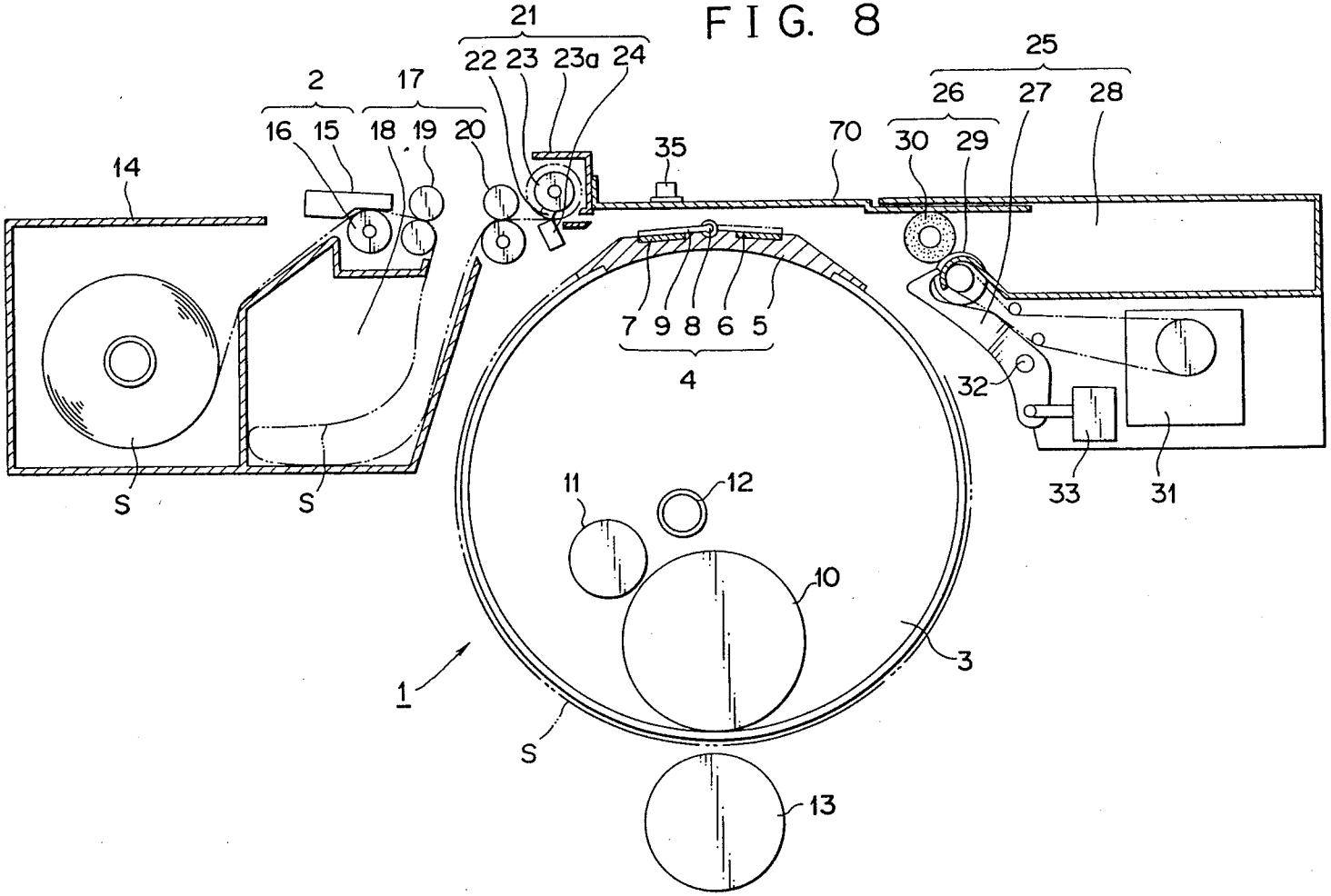
FIG. 8 is a view similar to FIG. 1, showing a modified apparatus according to a second embodiment.
Figure 9:
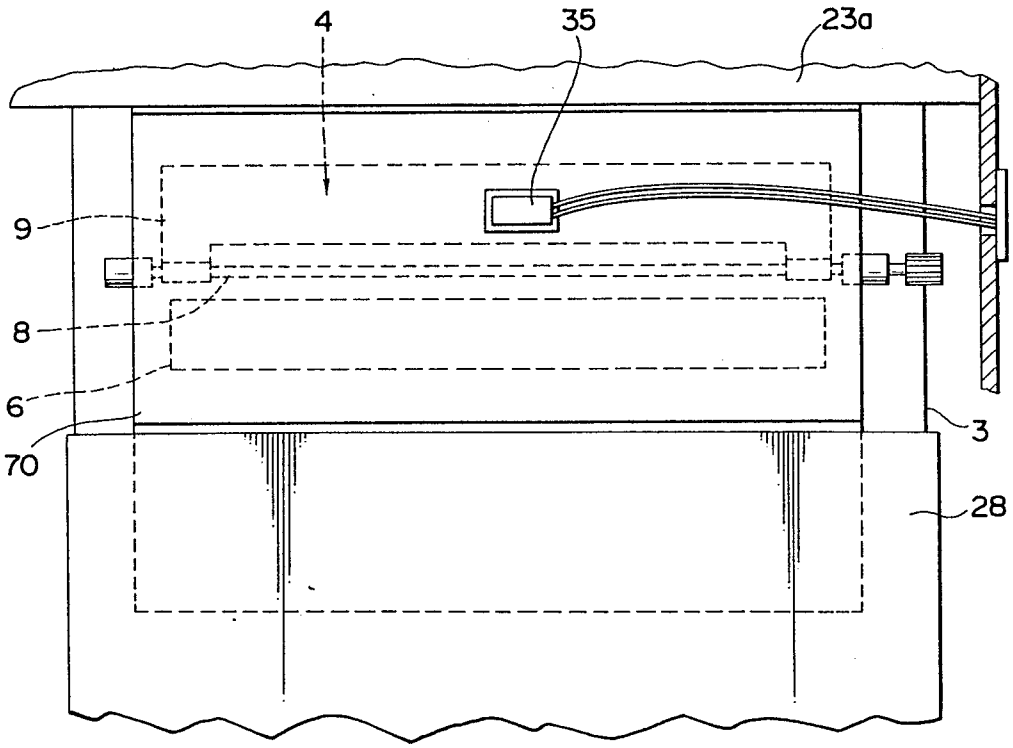
FIG. 9 is a fragmentary plan view of the modified apparatus of FIG. 8.

FIGS. 8 and 9 illustrate a second embodiment. The apparatus of the second embodiment is similar to the apparatus of the first embodiment, except that a sensor 35 is supported on a flexible guide 70 for detecting the leading end of the perforated stencil S. Each of the other parts is similar to the corresponding part of the first embodiment and is therefore designated by the same reference numeral as in FIGS. 1 and 2, its description being omitted here.

Specifically, the sensor 35 is fixedly mounted substantially centrally on an upper surface of the flexible guide 70. The sensor 35 serves to detect optically whether the perforated stencil S is held by the clamp 9, or whether the perforated stencil S arrives at a predetermined clamping position, and to output an electrical signal upon detection. For this purpose, the guide 70 is transparent at least at a portion where the sensor 35 is located. Otherwise, the guide 70 may have an opening in alignment with the sensor 35.

According to the second embodiment, since the flexible guide 70 is disposed at a position above and very close to the clamp 9 and the sensor 35 is supported on the guide 70 substantially centrally thereof to detect the center of the leading end of the stencil S, it is possible to detect the leading end of the stencil S reliably even if any side of the leading end of the stencil S is folded or bent. The apparatus of the second embodiment does not require either a highly sensitive sensor or a special process of detection signal.

Figure 10:
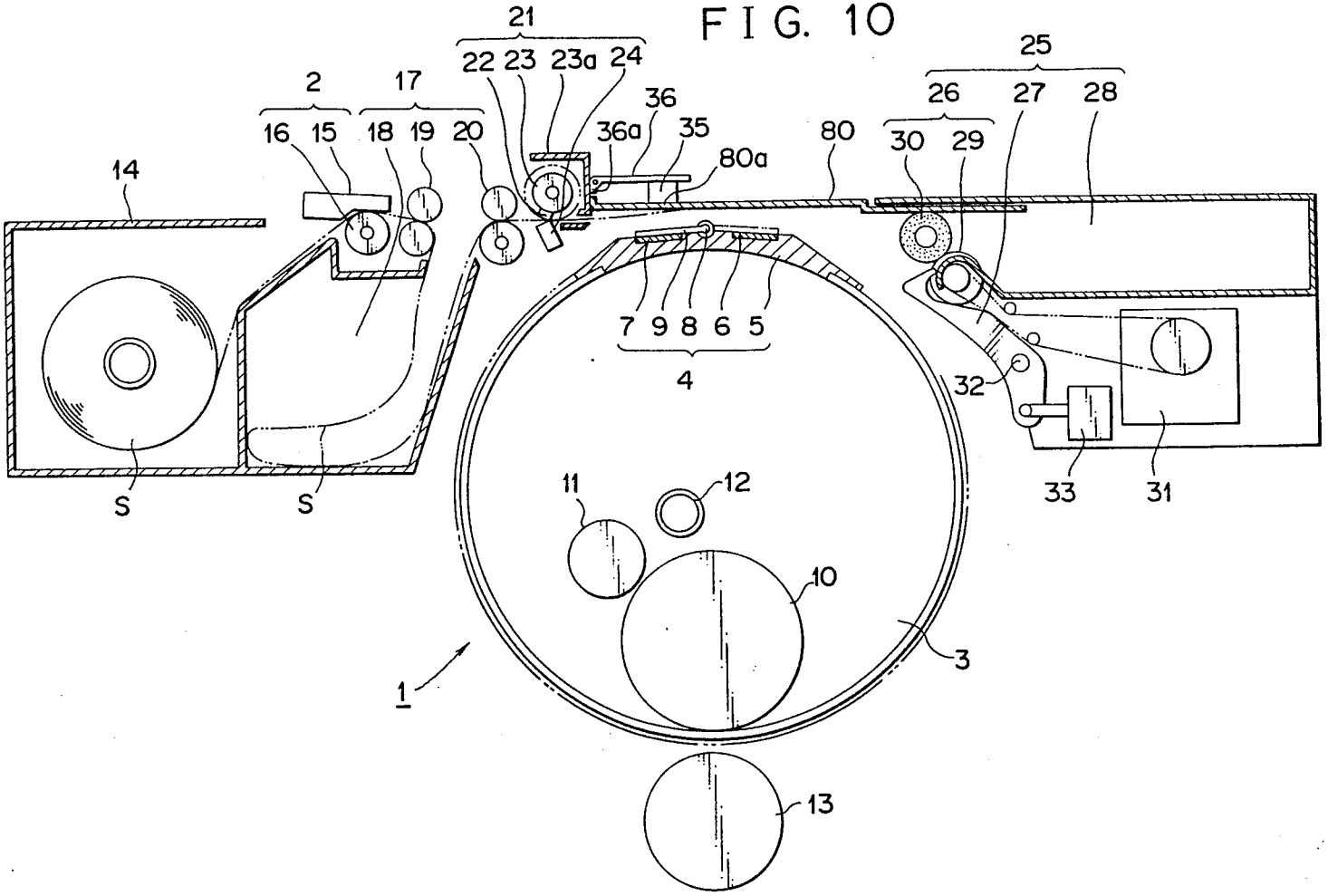
FIG. 10 is a view similar to FIG. 1, showing a third embodiment.

FIG. 10 illustrates a third embodiment. In the third embodiment and a fourth embodiment described below, parts similar to those of the first embodiment are designated by the same reference numerals as in FIG. 1.

A modified guide 80 of the third embodiment, like the guide 70 of the second embodiment, is flexible and has a central opening 80*a*. A sensor 35 is disposed above the guide 80 in alignment with the opening 80*a*. The sensor 35 is fixedly secured to the lower surface of a support plate 36 which is attached to a cover 23*a* for the rotary blade 23. The support plate 36 is pivotally connected at its base to the cover 23*a* and has a downward projection 36*a* extending from the base perpendicularly to the general plane of the support plate 36. Since the downward projection 36*a* is normally in contact with the vertical side surface of the cover 23*a*, the support plate 36 and thus the sensor 35 are kept from being pivotally moved downwardly beyond the horizontal position of FIG. 10. With this arrangement, there is no danger that any unnecessary load could exert on the flexible guide 80. When the clamp 9 is pivotally moved to flex the guide 80 upwardly, the sensor 35 and the support plate 36 are pivotally moved upwardly following the deformation of the guide 80.

In the first, second and third embodiments, because the guide 40, 50, 60, 70 or 80 is made of a flexible material the guide can be moved or deformed following the pivotal movement of the clamp 9. This deformation of the guide 40, 50, 60, 70 or 80 is only an example of the movement of the guide following the pivotal movement of the clamp 9. Therefore it is not essential to the present invention that the guide is made of a flexible material. For example, the guide may be a rigid member which is movable in contact with the clamp 9, as described in connection with the following embodiments.

Figure 11:
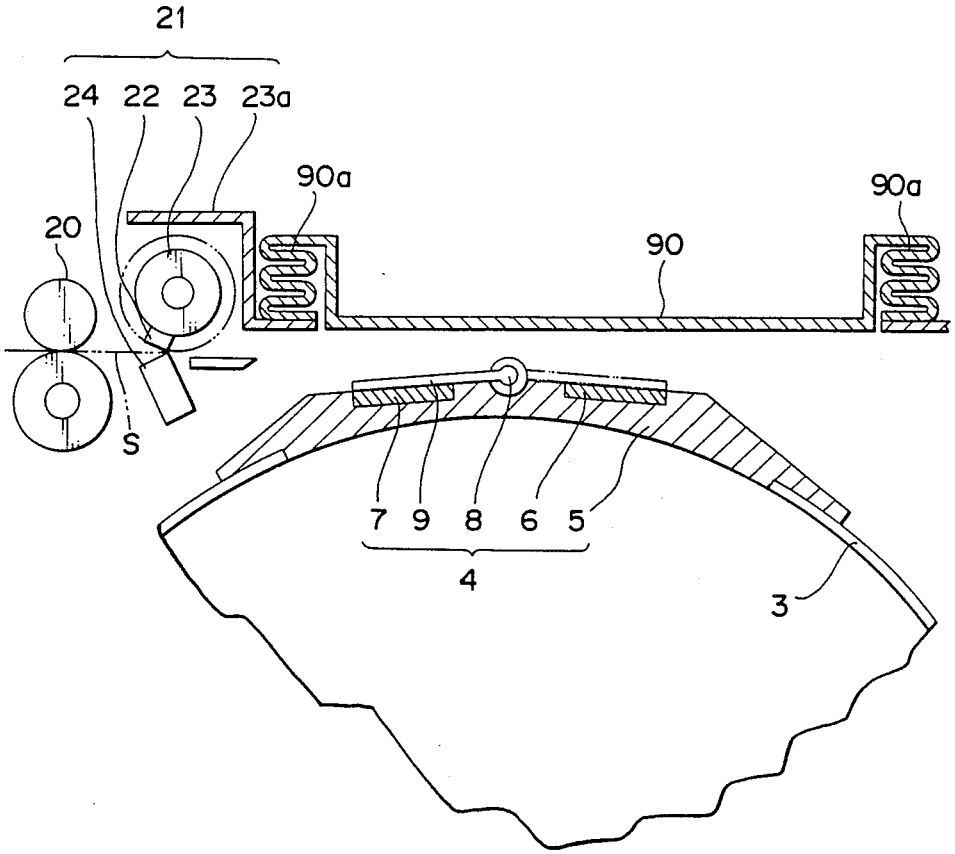
FIG. 11 is a fragmentary enlarged cross-sectional view showing a fourth embodiment.

FIG. 11 illustrates a fourth embodiment, in which a guide 90 in the form of a relatively rigid plate is disposed above the clamp 9. The guide 90 is provided at opposite ends with spring or resilient portions 90*a*, 90*a* fixed to the frame of the apparatus. As the clamp 9 is pivotally moved to contact the guide 90 when mounting and removing of the stencil S, the guide 90 is allowed to be displaced by the resilient portions 90*a*, 90*a*. At that time the guide 90 per se is not virtually deformed.

Figure 12:
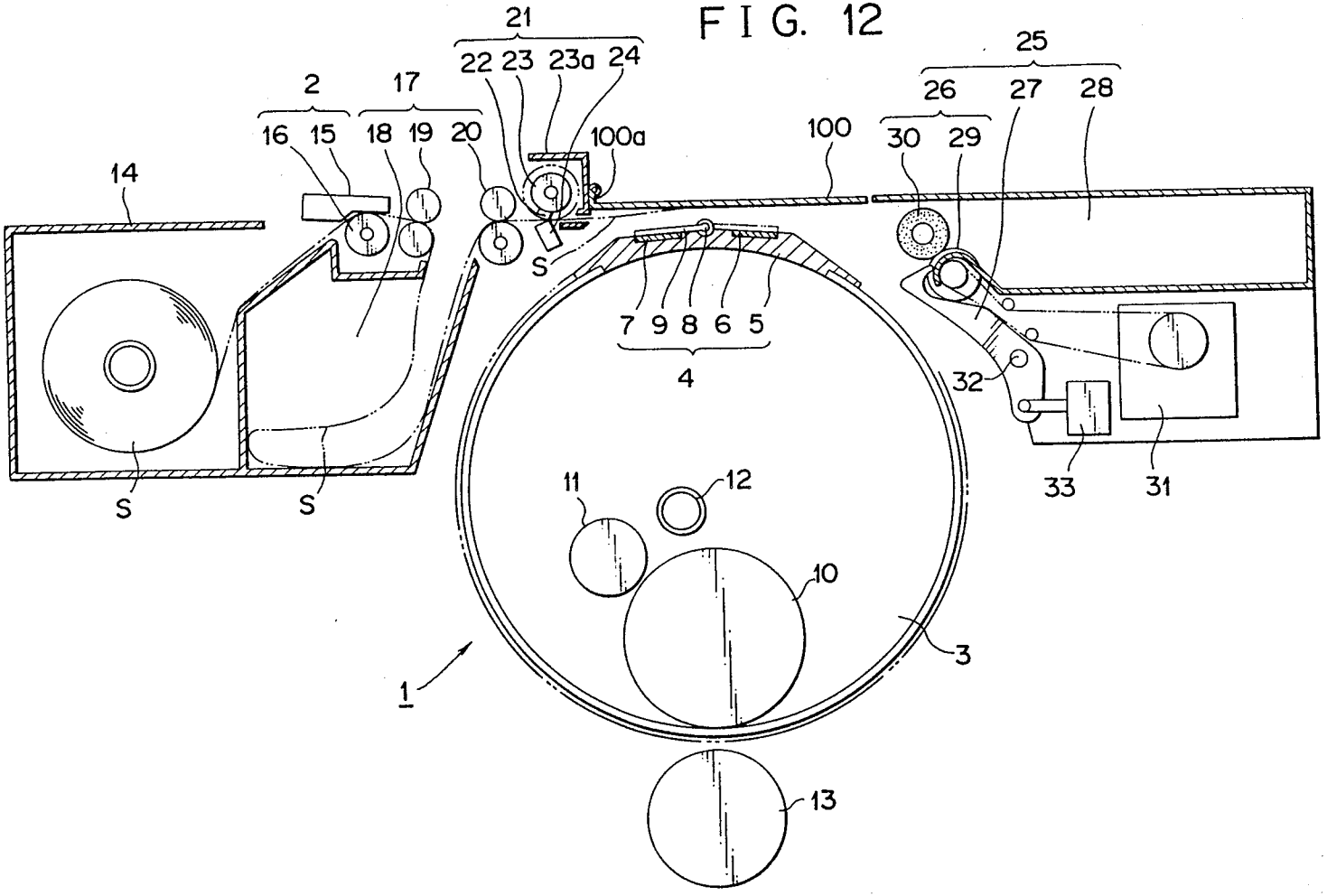
FIGS. 12 and 13 are cross-sectional views showing a fifth embodiment.
Figure 13:
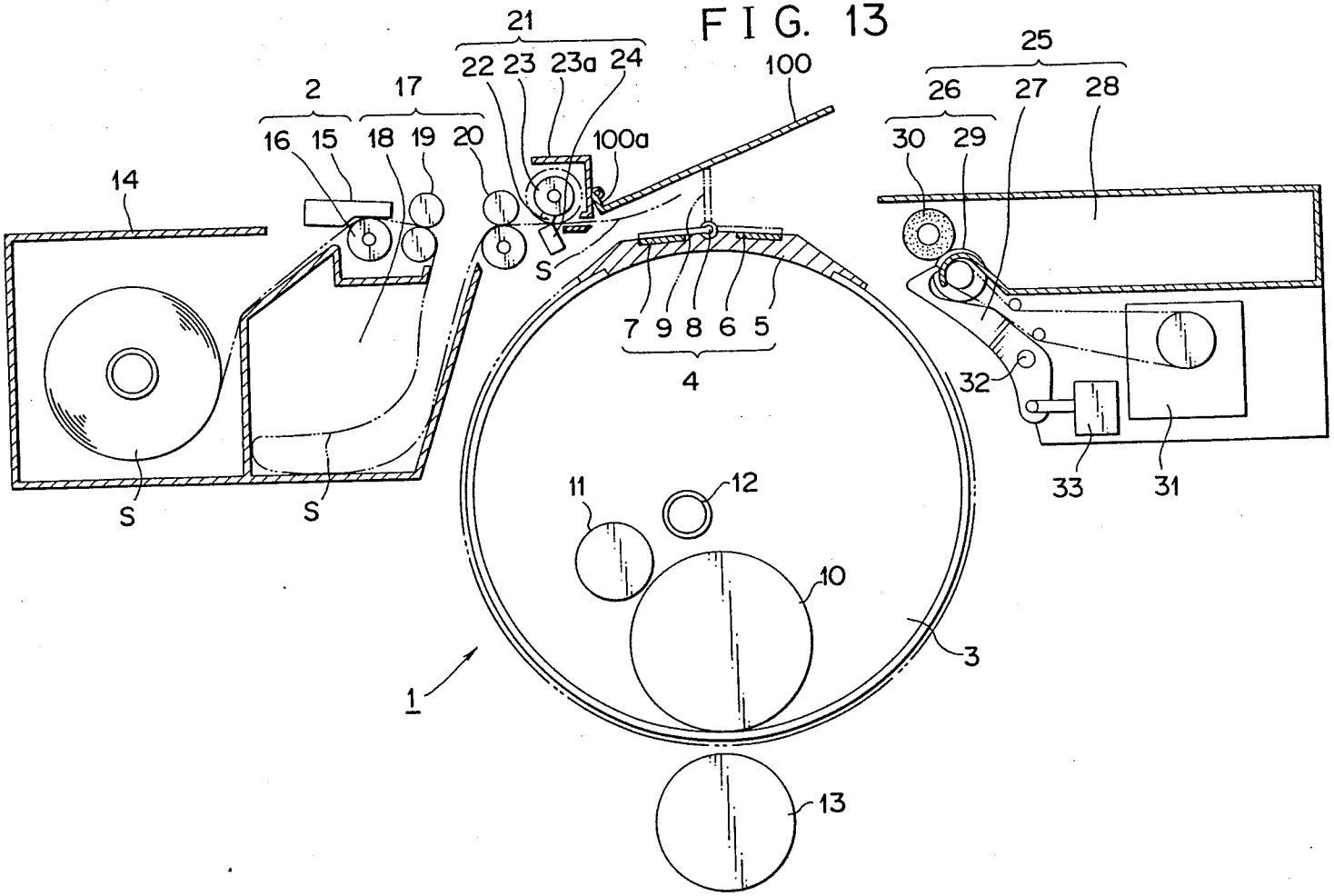

FIGS. 12 and 13 illustrate a fifth embodiment, in which a guide 100 in the form of a rigid plate is disposed above the clamp 9. The guide 100 has an upright bent edge portion 100*a* disposed adjacent to the cutting unit 21 and pivotally supported on the vertical side surface of the cover 23*a* for the rotary blade 23. With this arrangement, when the upright bent edge portion 100*a* is in contact with the side surface of the cover 23*a*, the general plane of the guide 100 lies horizontally above the clamp 9.

In mounting the stencil S on the rotary drum 3, when the clamp 9 is pivotally moved in relation to the conveying of the stencil S, the clamp 9 comes into contact with the lower surface of the guide 100 to cause the guide 100 to pivotally move upwardly.

Figure 14:
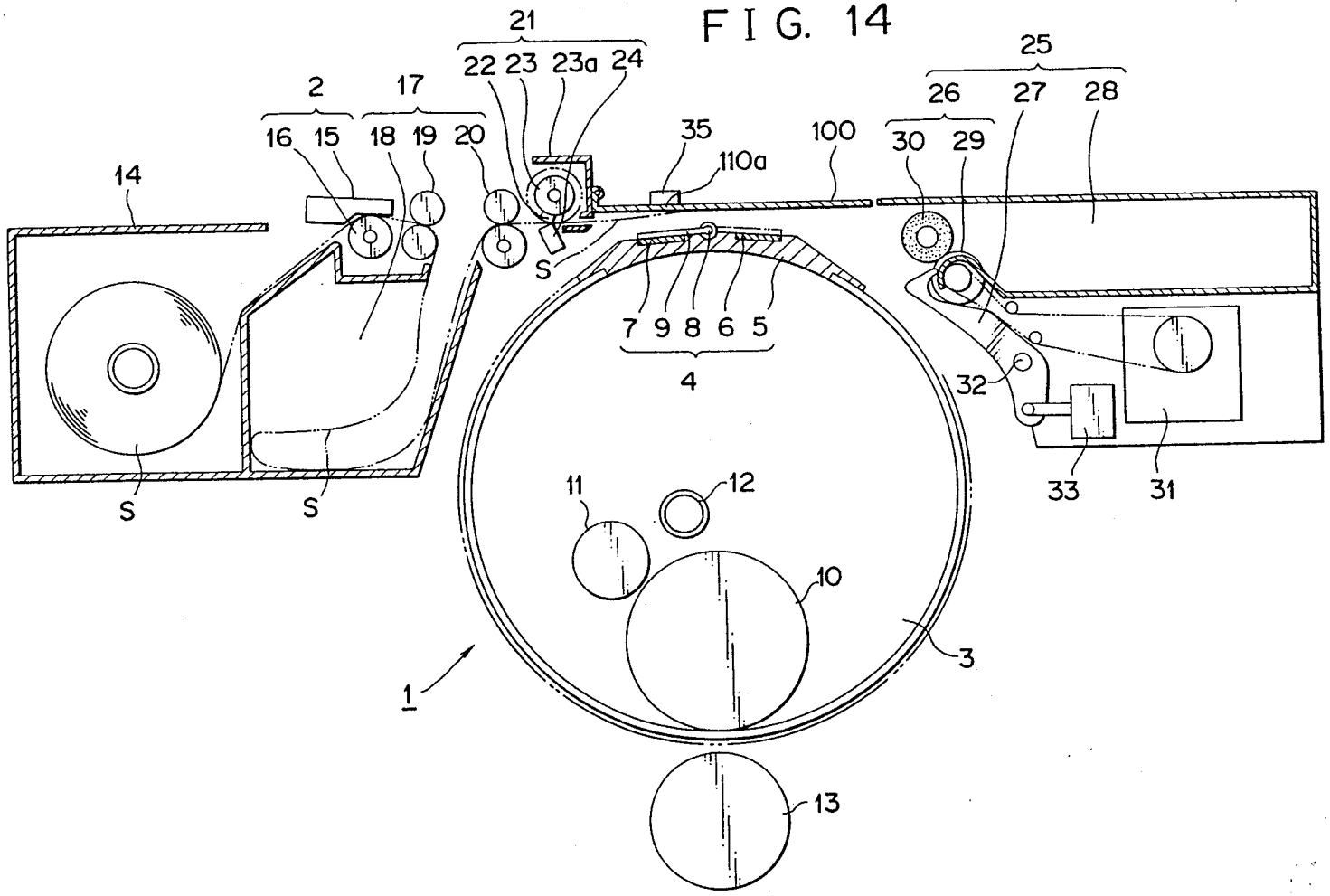
FIG. 14 is a cross-sectional view showing a sixth embodiment.
Figure 15:
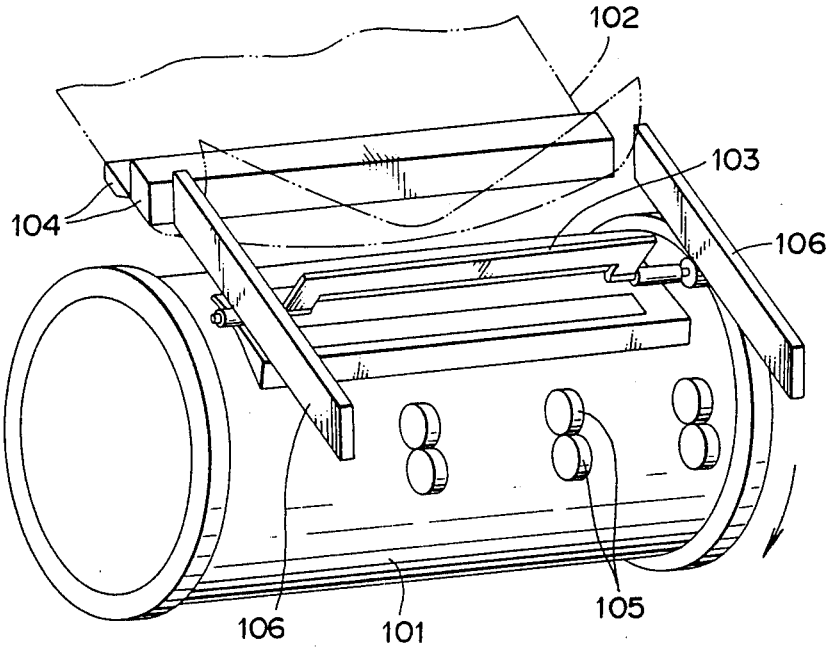
FIG. 15 PRIOR ART
FIG. 15 is a fragmentary schematic perspective view of a typical prior art apparatus.

FIG. 14 illustrates a sixth embodiment. The apparatus of the sixth embodiment is similar to the apparatus of the fifth embodiment, except that the guide 100 has a central opening 110*a* and carries on its upper surface a sensor 35 in alignment with the opening 110*a*, the sensor 35 being directly attached to the guide 100. According to the sixth embodiment, it is possible to obtain the same result as that of the second embodiment. Because of its rigidness, the guide 110 is not flexed at all even if the sensor 35 is directly mounted on the guide 110.

In the fourth, fifth and sixth embodiments, like the first, second and third embodiments, since the guide 90, 100 or 110 is movable or displaceable following the pivotal movement of the clamp 9, the pivotal movement of the clamp 9 is not impeded by the guide 90, 100 or 110. Further, the guide 90, 100 or 110 can guide the stencil S reliably, likewise the first, second and third embodiments.

In the fourth, fifth and sixth embodiments, the guide 90, 100 or 110 may have on its lower surface a plurality of such as shown in FIG. 7(*a*), and the clamp 9 may have in its distal end a plurality of grooves such as shown in FIG. 7(*a*).

Further, in the fifth and sixth embodiments, the guide may be pivotally attached to the disposal box 28 rather than the cover 23*a* for the rotary blade 23. Moreover, in the fifth and sixth embodiments, the guide 100 or 110 may be in the form of a plurality of rigid strips or rods such as shown in FIG. 5 or FIG. 6.

In the first through sixth embodiments, the guide 40, 0, 60, 70, 80, 90, 100 or 110 is disposed above the clamp 9 for engagement therewith and extends between the perforating unit 2 and the discharging unit 25 for guiding the stencil S even when mounting and removing the stencil S. Alternatively, the guide may extend between the perforating unit 2 and a position above the clamp 9 for guiding the stencil S only when mounting the stencil S. In another alternative form, the guide may extend between a position above the clamp 9 and the discharging unit 25 for guiding the stencil S only when removing the stencil S.

According to the mimeographic printing apparatus of the present invention, since a stencil guide is disposed above the rotary drum for engagement with the clamp so as to be movable or displaceable following the pivotal movement of the clamp, it is possible to guide the stencil to a predetermined position reliably when mounting and/or removing the stencil.

What is claimed is:

1. A mimeographic printing apparatus, comprising:

(a) a rotary drum for mounting on a peripheral surface thereof a perforated stencil;

(b) a clamp pivotally supported on said rotary drum for clamping one end of the stencil in such a manner that the stencil may be wound around said peripheral surface of said rotary drum in response to rotation of said rotary drum;

(c) means for removing the stencil from said rotary drum after printing is finished; and (d) a stencil guide engageable with said clamp at a first position above said rotary drum so as to move following the pivotal movement of said clamp.

2. A mimeographic printing apparatus according to claim 1, wherein said stencil guide extends between said first position and a second position from which the stencil is to be supplied to said rotary drum.

3. A mimeographic printing apparatus according to claim 1, wherein said stencil guide extends between said first position and a further position above said removing means.

4. A mimeographic printing apparatus according to claim 1, wherein said stencil guide has a width larger than the width of said clamp and is a flexible member deformable following the pivotal movement of said clamp.

5. A mimeographic printing apparatus according to claim 4, wherein said stencil guide has on a lower surface thereof a plurality of ridges engageable with said clamp in response to the pivotal movement of said clamp.

6. A mimeographic printing apparatus according to claim 5, wherein said clamp has in a distal end thereof a plurality of grooves corresponding to said ridges of said stencil guide.

7. A mimeographic printing apparatus according to claim 1, wherein said stencil guide is in the form of a plurality of flexible strips deformable following the pivotal movement of said clamp.

8. A mimeographic printing apparatus according to claim 7, wherein said stencil guide has on a lower surface thereof a plurality of ridges engageable with said clamp in response to the pivotal movement of said clamp.

9. A mimeographic printing apparatus according to claim 8, wherein said clamp has in a distal end thereof a plurality of grooves corresponding to said ridges of said stencil guide.

10. A mimeographic printing apparatus according to claim 1, wherein said stencil guide is in the form of a plurality of flexible rods deformable following the pivotal movement of said clamp.

11. A mimeographic printing apparatus according to claim 1, wherein said stencil guide is stationary at one end and free at the other end.

12. A mimeographic printing apparatus according to claim 1, wherein said stencil guide is stationary at both ends.

13. A mimeographic printing apparatus according to claim 1, wherein said stencil guide is in the form of a rigid plate which is attached at both ends to a stationary frame of the apparatus by means of a spring.

14. A mimeographic printing apparatus according to claim 1, wherein said stencil guide is in the form of a rigid plate which is pivotally attached at one end to a stationary frame of the apparatus so as to be pivotable upwardly from a horizontal position.

15. A mimeographic printing apparatus according to claim 14, wherein a sensor is attached to said stencil guide substantially centrally thereof for detecting a leading end of said stencil.

16. A mimeographic printing apparatus comprising:

(a) a rotary drum for mounting on a peripheral surface thereof a perforated stencil;

(b) a clamp supported by said rotary drum for clamping one end of the stencil in such a manner that the stencil may be wound around said peripheral surface of said rotary drum in response to rotation of said rotary drum;

(c) means for removing the stencil from said rotary drum after printing is finished;

(d) a stencil guide engageable with said clamp at a first position above said rotary drum so as to move following the pivotal movement of said clamp, said stencil guide having substantially centrally thereof a transparent portion;

(e) a support plate disposed above said stencil guide and supporting said stencil guide for upward pivotal movement; and (f) a sensor attached to a lower surface of said support plate in alignment with said transparent portion o said stencil guide for detecting a leading end of the stencil supplied to said rotary drum.

* * * * *